US006164958A

United States Patent [19]

Huang et al.

[11] Patent Number: 6,164,958

[45] Date of Patent: Dec. 26, 2000

[54] SAFETY SYSTEM FOR GAS RANGE

[76] Inventors: Tai-Tung Huang; Po-Hao Huang, both of 10430 Westchester Ave., San Diego, Calif. 92126

[21] Appl. No.: 09/398,705

[22] Filed: Sep. 20, 1999

[51] Int. Cl.[7] ..... F23N 5/24; F23N 5/26; F24F 7/007

[52] U.S. Cl. ..... 431/16; 431/22; 431/77; 431/81; 431/83; 431/84; 126/39 BA

[58] Field of Search ..... 431/13, 15, 16, 431/22, 89, 77, 81, 83, 84; 126/39 BA

[56] References Cited

U.S. PATENT DOCUMENTS

| | | | |
|---|---|---|---|
| 4,142,851 | 3/1979 | Handa | 431/16 |
| 4,930,488 | 6/1990 | Pearman et al. | 126/39 BA |
| 5,039,006 | 8/1991 | Habegger | 431/22 |

FOREIGN PATENT DOCUMENTS

| | | | |
|---|---|---|---|
| 52-500390 | 4/1977 | Japan | 431/16 |
| 54-140234 | 10/1979 | Japan | 431/22 |
| 56-165831 | 12/1981 | Japan | 431/22 |
| 57-101226 | 6/1982 | Japan | 431/22 |
| 2-178522 | 7/1990 | Japan | 431/39 BA |
| 4041186017 | 7/1992 | Japan | 431/16 |

*Primary Examiner*—Carl D. Price
*Attorney, Agent, or Firm*—Calif Tervo

[57] ABSTRACT

A safety system for a gas burning device, such as a gas range having a plurality of burner assemblies. The safety system generally comprises a gas supply valve, a gas flow sensor, a gas leak warning circuit, a no-flame warning circuit, a gas supply valve controller for receiving warning signals from the warning circuits and for closing said gas supply valve in response thereto and a fan controller for activating the fan. Other warning circuits include a timer warning circuit and a smoke detection warning circuit. A display panel shows which warning circuit has issued a warning signal. A microprocessor may perform many system functions.

12 Claims, 2 Drawing Sheets

SAFETY SYSTEM FOR GAS RANGE

FIELD OF THE INVENTION

This invention relates to a safety and shut-off system for a gas burner, and more specifically to a safety and shut-off system for a multi-burner gas range.

BACKGROUND OF THE INVENTION

Gas burners, such as gas ranges, are subject to failures and other conditions which render them dangerous. For example, a gas leak may cause an explosion or fire or may suffocate people. If a burner fails to light or is extinguished by an overflowing pot, continued gas flow may result in an explosion or fire or may suffocate people. Many fires, explosions, and suffocations are attributable each year to gas burners. An additional hazard is created because conventional gas ranges do not automatically turn off after a period of time. Thus, a lit burner left unattended may eventually burn the contents, thereby causing smoke damage or a fire or the contents may boil over and extinguish the flame resulting in even more disastrous effect discussed above.

Therefore, there has been a need for a safety system for a gas range that turns off the gas supply to the range upon detection of a gas leak, absence of a flame, or smoke.

It would be additionally desirable that such a system include a method of turning off a gas burner after a selected time period.

SUMMARY OF THE INVENTION

This invention is a safety system for a gas burning device. In an exemplary embodiment, the safety system is included with a gas range having a plurality of burner assemblies. The safety system generally comprises a gas supply valve, a gas flow sensor, a gas leak warning circuit, a no-flame warning circuit, a gas supply valve controller for receiving warning signals from the warning circuits and for closing said gas supply valve in response thereto, and a fan controller for activating the fan. Other warning circuits include a timer warning circuit and a smoke detection warning circuit. A display panel shows which warning circuit has issued a warning signal.

Another preferred embodiment uses an electronic control unit including a microprocessor to perform many system functions.

An exemplary embodiment of a gas supply valve is shown.

Other features and many attendant advantages of the invention will become more apparent upon a reading of the following detailed description together with the drawings wherein like reference numerals refer to like parts throughout.

DETAILED DESCRIPTION OF THE INVENTION

Figures 1, 3, 4:
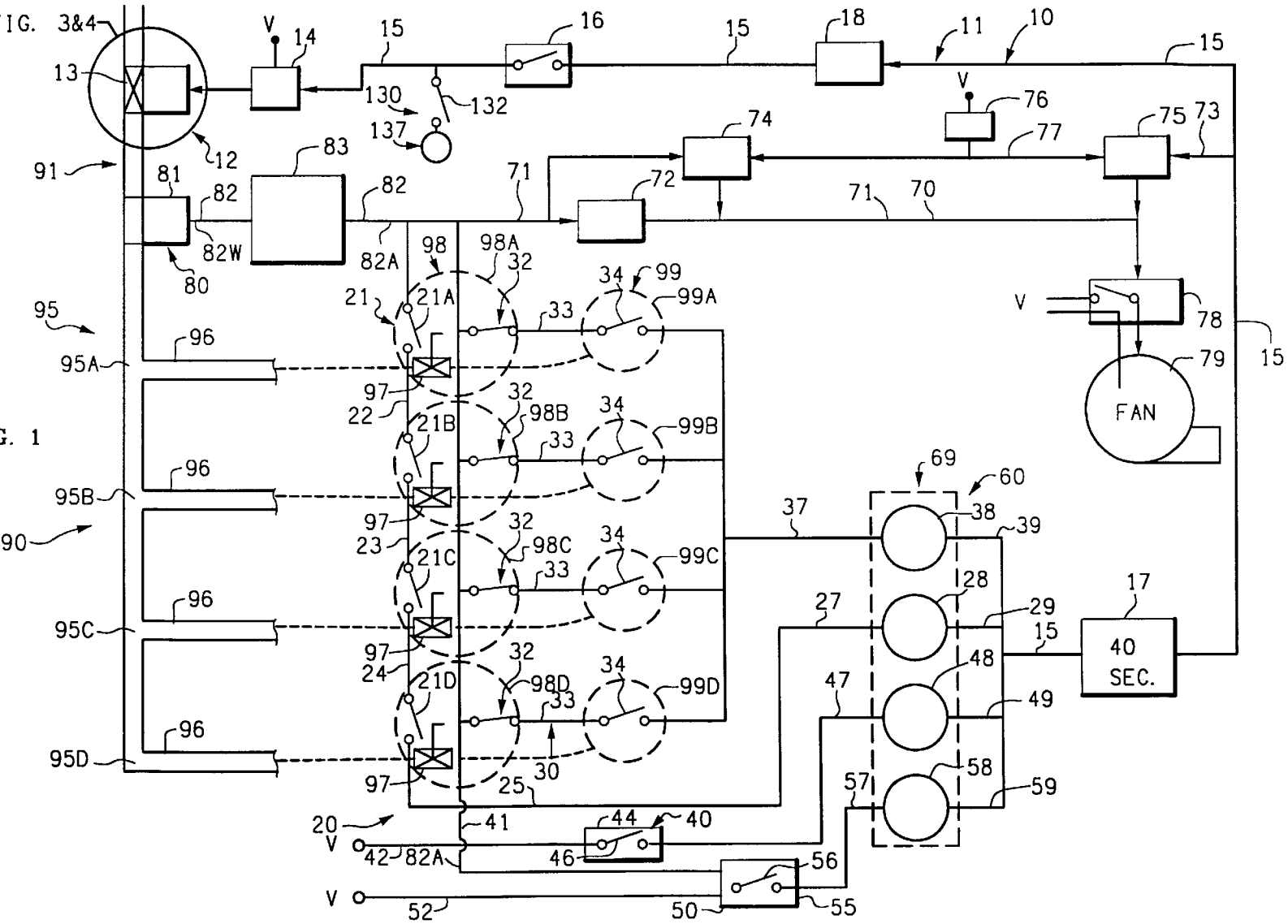
FIG. 1 is a diagrammatic depiction of the gas range safety system of the invention.
FIG. 3 is a front elevation view of an exemplary embodiment of a gas supply valve means with the valve in the open position.
FIG. 4 is a front elevation view of the gas supply valve means of FIG. 3 in the valve in the closed position.
Figure 3:
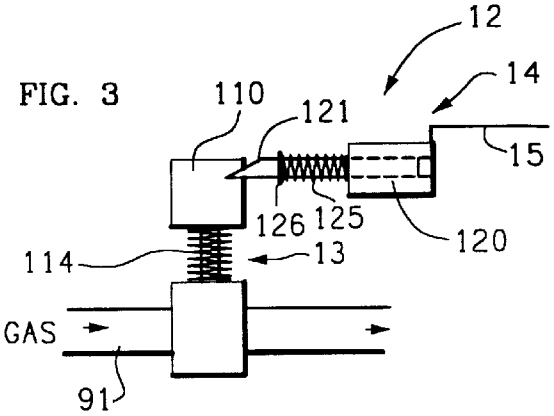
Figure 4:
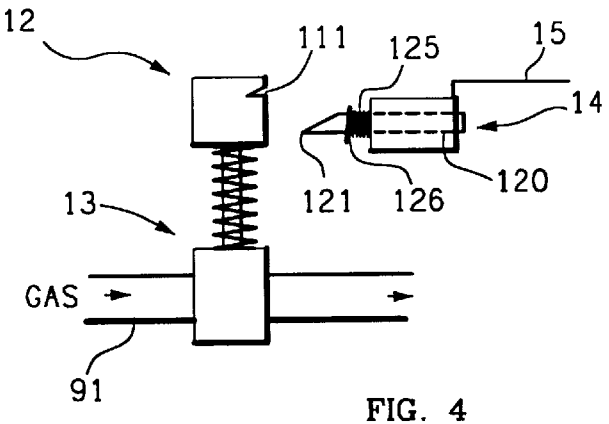

With reference now to the drawings, there is shown in FIG. 1 a diagrammatic depiction of the gas range safety system 10 of the invention in combination with a gas range 90 having four burners 99. Although a typical four burner gas range 90 is shown and described, it will be seen that safety system 10 is applicable to any gas burning apparatus having one or more burners. Range 90 generally includes a main gas conduit 91 providing a source of gas and a plurality of burner assemblies 95, also designated first fourth burner assembly 95A–95D. The suffixes A–D will be used to designate first-fourth of similar elements. Each burner assembly 95 includes a burner 99, a burner gas conduit 96 for conducting gas from main gas conduit 91 to burner 99, and a burner control valve 97 having a closed position wherein burner gas conduit 96 is closed and having an open position wherein burner gas conduit 96 is open. Each burner control valve 97 includes and is typically operated by a manually rotatable range knob 98, such first-fourth knobs 98A–98D.

Safety system 10 generally includes a gas control circuit 11, a gas flow sensor circuit 80, a gas leak warning circuit 20, a no-flame warning circuit 30, a timer circuit 40, a smoke detection circuit 50, a fan circuit 70 and a warning display panel 60.

Gas control circuit 11 generally includes gas supply valve means 12 for controlling gas flow in gas conduits 91, 96. Gas supply valve means 12 includes one or more gas supply valves in conduits 91, 96, such as gas supply valve 13, and a gas supply valve controller 14. Gas supply valve 13, disposed such as in main gas conduit 91, has a closed position preventing gas flow in the main gas conduit 91.

Gas flow sensor circuit 80 includes a gas flow sensor 81. Gas flow sensor 81 produces a flow signal on a flow signal line 82, such as weak flow signal line 82W, indicating gas flow in main gas conduit 91. Amplifier 83 receives the flow signal and outputs an amplified flow signal, such as a five volt D.C. signal, on a flow signal line 82, such as on amplified flow signal line 82A. Several types of gas flow sensors 81 suitable for inclusion in system 10 are commercially available. Gas leak warning circuit 20 includes a plurality of leak switches 21, such as first-fourth leak switch 21A–21D, connected in series. Each leak switch 21 is paired to a range knob 98 and is switchable thereby to the closed position to indicate that burner control valve 97 is closed. First leak switch 21A receives the flow signal and produces a leak signal on line 22 if its burner control valve 97A is closed and there is a flow signal. Second leak switch 21B receives the leak signal from line 22 and produces a leak signal on line 23 if second burner control valve 97B is closed and a leak signal is received. Third leak switch 21C receives the leak signal from line 23 and produces a leak signal on line 24 if third burner control valve 97C is closed and a leak signal is received. Fourth leak switch 21D receives the leak signal from line 24 and produces a leak signal on line 25 if fourth burner control valve 97D is closed and a leak signal is received. If all switches 21 are closed, then the final signal on line 25 is called the leak warning signal. Thus, gas leak warning circuit 20 receives the flow signal and produces a leak warning signal on leak warning line 27 if the flow signal is received and each leak switch 21 indicates its burner control valve 97 is closed.

No-flame warning circuit 30 generally includes a plurality of flame switches 32 and a plurality of flame detectors 34. Each flame switch 32 is paired to a burner control valve 97 so as to be closed if its burner control valve 97 is open, i.e. its range knob 98 is turned on. Each flame switch 32 is connected to flow signal line 82A for receiving the flow signal. Each said flame switch 32 is coupled to its burner control valve 97 so as to produce an on signal on its output line 33 if its burner control valve 97 is open and there is a flow signal.

Each flame detector 34 is paired with a flame switch 32 for receiving the on signal therefrom. Each flame detector 34 is also paired with a burner 99 for detecting a flame thereat. Each flame detector 34 produces a no-flame warning signal on no-flame warning line 37 if no flame is detected and the on signal is received. Flame detector 34 may be a thermal switch activated by heat from its paired burner 99. Other flame detectors, such as optical flame sensors, are commercially available and may be used.

Timer circuit 40 includes a timer 44 including a switch 46. Timer circuit 40 is activated by the signal on flow signal line 82A. Timer circuit 40 also may conveniently receive its power from flow signal line 82A, or may have an alternate power line 42, such as house power V or from a low voltage rectifier (not shown). Timer switch 46 is ordinarily open. However, if timer 44 is set by the user to a specific time period, switch 46 will close at passage of the time chosen thereby producing a timer warning signal on time warning signal line 47.

Smoke detector circuit 50 includes a smoke detector 55 including a switch 56. Smoke detector circuit 50 is activated by the signal on flow signal line 82A. Smoke detector circuit 50 also may conveniently receive its power from flow signal line 82A, or may have an alternate power line 52, such as house power V. Smoke detector 55 is of conventional design for detecting smoke and produces a smoke warning signal on smoke warning signal line 57 in response to detecting smoke.

Warning panel 60 indicates which safety hazard is present. Warning panel 60 includes a plurality of warning indicators 69, such as a light or a buzzer or both, for alerting the user if a warning signal is received. A no-flame warning indicator 38 is activated during receipt of a no-flame warning signal on line 37 and outputs a warning signal on line 39. A leak warning indicator 28 is activated during receipt of a leak warning signal on line 27 and outputs a warning signal on line 29. A timer warning indicator 48 is activated during receipt of a timer warning signal on line 47 and outputs a warning signal on line 49. A smoke warning indicator 58 is activated during receipt of a smoke warning signal on line 57 and outputs a warning signal on line 59.

Warning signal line 15 receives the warning signals and ultimately transmits them to gas supply valve controller 14 which closes gas supply valve 13 in response to receipt of a warning signal. In this manner, if there is any indication of range malfunction, the gas source is turned off.

A no-flame warning signal may need to be delayed from the time gas flow is first detected to allow for flame detectors 34, such as of the heat detection type, to detect burning of gas at the burner 99. Otherwise, safety circuit 10 would immediately shut off gas flow because a no-flame warning signal would be immediately produced. In such a case, a signal propagation delay means 17 is interposed in the signal path that includes at least the no-flame circuit. Signal propagation delay means 17 receives the flow signal, the on signal, or the no-flame warning signal and propagates the received signal after a period of time sufficient for flame detector 34 to detect a flame, such that non-detection of a flame by flame detector 34 does not immediately cause closing of gas supply valve 13. For one common heat detection switch 34 sold, a delay time of forty seconds is sufficient. In the exemplary embodiment, signal propagation delay means 17 is imposed in warning line 15 so as to receive all of the warning signals. Having a delay, such as signal propagation delay means 17, in the leak warning path also adds stability to the system in that gas flow may be detected during a short time interval after the closing of burner control valve 97 and it is undesirable to close gas supply valve 13 in such an event.

An additional signal propagation delay means 18 is interposed in warning signal line 15 before gas supply valve controller 14 to delay the shut off of gas so that fan 79 will run for the time after generation of any warning signal. Delay 18 need only be for a short duration, such as three seconds to assure that fan 79 is activated by timer switch 75 and remains on for delay time.

A pulsed switching device 16 is interposed in warning signal line between delay means 18 and controller 14. In response to receipt of a warning signal from delay means 18, pulsed switching device 16 intermittently outputs the warning signal to operate controller 14. For example, the signal could be on for one second and off for two seconds. This intermittent signal instead of a constant signal prevents damage to controller 14.

Alarm circuit 130 receives the intermittent signal from pulsed switching device 16 and activates an alarm 137, such as an audible buzzer or bell, in response thereto. A user controlled switch 132 turns off the alarm.

The delay means 17, 18, or 72, may consist of any of several well known elements, such as a time delay switch, time delay circuit, or time delay relay, or may be performed in software.

Fan circuit 70 includes a vent fan 79 for venting smoke and unburned gas from the vicinity of range 90. Fan circuit 70 receives the flow signal, such as from flow signal line 82A and activates vent fan 79 in response to receipt of a flow signal. A signal propagation delay means 72 which delays propagation of the signal for a period of time, such as 40 seconds, is interposed in the received signal path to delay activation of fan 79. Delay 72 protects the fan switch and/or motor from multiple start-ups from the human tendency to switch a range knob 98 rapidly on and off several times in activating a burner 99.

Means, such as fan first timer switch means 74 and fan second timer switch means 75, is provided for fan 79 to remain running for a period of time after no flow signal is generated. Fan first timer switch means 74 and fan second timer switch means 75 are powered, such as by a five volt direct current on line 77 from transformer/rectifier 76 powered by house current V.

Fan first timer switch means 74 is connected to a flow signal line 82, such as to 82A. If first timer switch means 74 receives a flow signal and then does not, it outputs a fan activation signal for activating fan 79 for a period of time, such as for 40 seconds.

Fan second timer switch means 75 is connected by warning signal receipt line 73 to warning signal line 15 for receiving a warning signal. In response to receipt of a warning signal, fan second timer switch means 75 outputs a signal on fan activation line 71 for activating fan 79. Fan second timer switch means 75 continues to output the fan activation signal for a period of time, say 120 seconds, after non-receipt of the warning signal from line 15.

Thus, fan 79 will vent for a period of time after receipt of a warning signal, such as because of no-flame, to allow unburned gas to clear the room. Typically, fan 79 would be powered by house alternating current line V. In which case, a fan controller, such as relay 78 or a triac is used to switch line V to activate fan 79. Fan circuit 70 may also include a light that is activated with fan 79 or may be separately operated. A conventional fan and light may be used with a retro-fit on/off control attached.

Figure 2:
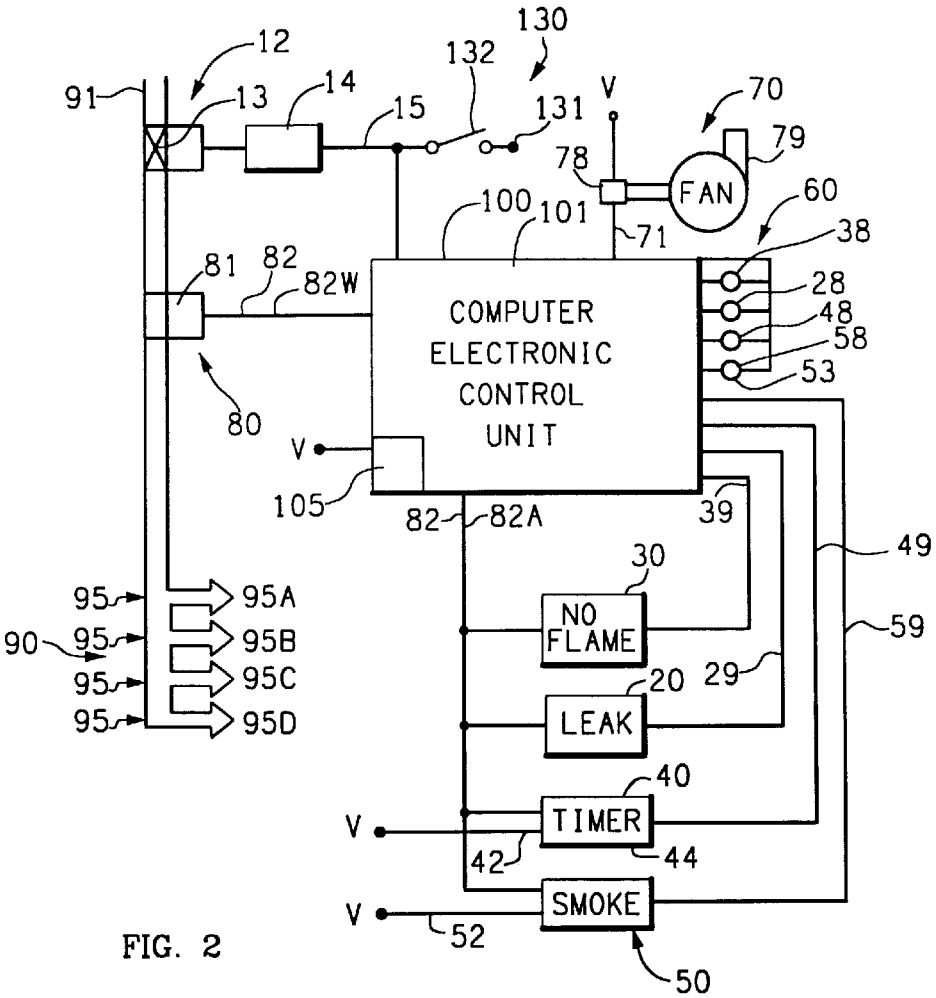
FIG. 2 is a diagrammatic view of an alternate embodiment of the safety system.

FIG. 2 is a diagrammatic view of an alternate embodiment of safety system 10 in which several of the elements and functions are incorporated into an electronic control unit 100 including a computer such as a microprocessor 101. Electronic control unit 100 may be powered by an power source, such as battery 105, so as to be independent from house electrical power.

Electronic control unit 100 receives the flow signal from flow sensor 81 on weak flow signal line 82W and responsive thereto outputs an amplified flow signal on amplified flow signal line 82A. Leak circuit 20, no-flame circuit 30, timer circuit 40, and smoke detector circuit 50 operate essentially as described with respect to FIG. 1 and output warning signals on warning signal lines 29, 39, 49, 59 respectively. Timer 44 and smoke detector 50 may be powered by battery 105.

Electronic control unit 100 receives the leak circuit 20 warning signal from line 29, and, after a short time delay, outputs a warning signal on warning signal line 15 for stopping gas flow and activates leak warning indicator 28.

Electronic control unit 100 receives the no-flame circuit 30 warning signal from line 39, and, after a suitable time delay, outputs a warning signal on warning signal line 15 for stopping gas flow and activates no-flame warning indicator 38.

Electronic control unit 100 receives the timer circuit 40 warning signal from line 49, and outputs a warning signal on warning signal line 15 for stopping gas flow and activates timer warning indicator 48.

Electronic control unit 100 receives the smoke circuit 50 warning signal from line 59, and outputs a warning signal on warning signal line 15 for stopping gas flow and activates smoke warning indicator 58.

Electronic control unit 100 receives the leak circuit 20 warning signal from line 29, and outputs a warning signal on line 73 for activating fan 79 and continues to activate fan for a select period of time following cessation of receipt of a leak warning signal. Electronic control unit 100 receives the no-flame circuit 30 warning signal from line 39, and outputs a warning signal on line 73 for activating fan 79 and continues to activate fan for a. select period of time following cessation of receipt of a no-flame warning signal. Electronic control unit 100 can function similarly to warning signals from the timer circuit 40 and smoke detector circuit 50. Thus, fan 79 will vent for a period of time after receipt of a warning signal, such as because of a leak or no-flame condition, to allow unburned gas to clear the room.

The use of a microprocessor 101 in control unit 100 allows the system parameters to be easily configured for the specific application. For example, the delay times can be optimized. The no-flame delay time can be minimized to reflect the specific method of flame detection employed. The timer circuit may be applied to a specific burner or burners.

FIGS. 3 and 4 show exemplary embodiments of gas supply valve means 12 with FIG. 3 being a front elevation view thereof with valve 13 in the open position and with FIG. 4 being a front elevation view thereof with valve 13 in the closed position.

Gas supply valve 13 includes means for manual open/close operation. Gas supply valve 13 includes manual setting means, such as push button 110, which is manually pushed in for setting valve 13 to the open position. Biasing means, such as spring 114, biases push button to the closed position. Gas supply controller 14 includes means, such as a solenoid 120 for moving a locking pin 121. Locking pin 121 has an outer end for engaging button 110, such as in notch 111. Responsive to a warning signal, solenoid 120 moves locking pin 121 from an engaged position as seen in FIG. 3, wherein locking pin retains button 110 in the open position, to a disengaged position as seen in FIG. 4 releasing button 110 whereby button 110 is moved to the closed position. Biasing means, such as spring 125, biases locking pin 121 toward the engaged position. Means, such as collar 126 attached to pin 121, retains the outer end of spring 125 and can be manually moved to disengage pin 121 so as to release button 110 and close valve 13.

It can be seen that system 10 is adaptable to a single burner 99 or a plurality of systems 10 can be applied to a multi-burner range 90. For example, each burner gas conduit 96 may include a gas valve controller for a gas supply valve in each burner gas conduit 96 or for the burner control valve 97 and may include a flow sensor in each burner gas conduit, such that each burner 99 can be independently turned-off, such as for failure to light, flame extinguished or for time being up.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A safety system for a gas burning apparatus; the gas burning apparatus being manually operable without electricity; the gas burning apparatus including a burner, a gas supply conduit for conducting gas to the burner, a manually operable control valve having a closed position closing the gas supply conduit and having an open position opening the gas supply conduit; said safety system comprising:

a gas supply valve connected to the gas supply conduit and movable between an open position wherein the gas supply conduit is open and a closed Position wherein the gas supply conduit is closed; said gas supply valve including:

biasing means for biasing said gas supply valve toward the closed position; and a stop movable between a stop position wherein it may engage said gas supply valve thereby retaining said gas supply valve in the open position, and a release position not engaging said gas supply valve whereby said gas supply valve is closed or closes;

a gas flow sensor for producing a flow signal indicating gas flow in the gas supply conduit;

a gas leak warning circuit comprising:

a first leak switch for receiving the flow signal; said first leak switch coupled to the control valve so as to produce a leak warning signal if the control valve is closed and there is a flow signal;

a no-flame warning circuit comprising:

a first flame switch for receiving the flow signal; said first flame switch coupled to the control valve so as to produce an on signal if the control valve is open and there is a flow signal;

a flame detector for receiving the on signal and for detecting a flame at the burner; said flame detector producing a no-flame warning signal if no flame is detected and the on signal is received;

a gas supply valve controller for receiving the warning signals; said gas supply valve controller connected to said stop including:

means for moving said stop to the release position [and for closing said gas supply valve in response to] during receipt of a warning signal.

2. The safety system of claim 1 further including:

a warning indicator for receiving a warning signal and for alerting the user if a warning signal is received.

3. The safety system of claim 1 wherein:

said gas leak warning circuit includes:

a warning indicator for receiving the leak warning signal and for alerting the user if the warning signal is received.

4. The safety system of claim 1 wherein:

said no-flame warning circuit includes:

a warning indicator for receiving the no-flame warning signal and for alerting the user if the warning signal is received.

5. The safety system of claim 1 further including:

propagation delay means for receiving the flow signal, the on signal or the no-flame warning signal and propagating the received signal after a period of time sufficient for said flame detector to detect a flame such that non-detection of a flame by said flame detector does not immediately cause closing of said gas supply valve.

6. The safety system of claim 1 further including:

a timer circuit including a timer for producing a timer warning signal after passage of a time selected by the user.

7. The safety system of claim 1 further including:

a smoke detector circuit including a smoke detector for detecting smoke and for producing a smoke warning signal in response to detecting smoke.

8. The safety system of claim 1 further including:

a fan circuit including:

a vent fan for receiving activation signals for activation by receipt of an activation signal;

a fan delay for receiving a flow signal and for producing an activation signal during receipt of a flow signal starting at a predetermined time after first receipt of a flow signal;

first fan timer means for receiving a flow signal and, upon cessation of receipt of a flow signal, for producing an activation signal for a predetermined period of time; and second fan timer for receiving a warning signal and for producing an activation signal during receipt of a warning signal and for a predetermined period of time after cessation of receipt of a warning signal.

9. The safety system of claim 8 further including:

a warning indicator for receiving a warning signal and for alerting the user if a warning signal is received.

10. The safety system of claim 8 further including:

propagation delay means for receiving the flow signal, the on signal or the no-flame warning signal and propagating the received signal after a period of time sufficient for said flame detector to detect a flame such that non-detection of a flame by said flame detector does not immediately cause closing of said gas supply valve.

11. The safety system of claim 8 further including:

a timer circuit including a timer for producing a timer warning signal after passage of a time selected by the user.

12. The safety system of claim 8 further including:

a smoke detector circuit including a smoke detector for detecting smoke and for producing a smoke warning signal in response to detecting smoke.

* * * * *